United States Patent [19]

Grundell

[11] 4,229,022

[45] Oct. 21, 1980

[54] FILING FOLDER FOR PERFORATED PAPERS

[76] Inventor: Carl-Erik Grundell, Osmogatan 8, S-122 48 Enskede, Sweden

[21] Appl. No.: 879,557

[22] Filed: Feb. 21, 1978

Related U.S. Application Data

[63] Continuation of Ser. No. 764,932, Feb. 2, 1977, abandoned, which is a continuation of Ser. No. 522,065, Nov. 8, 1974, abandoned, which is a continuation-in-part of Ser. No. 398,765, Sep. 19, 1973, abandoned.

[51] Int. Cl.[3] ..... B42F 9/00

[52] U.S. Cl. ..... 281/45; 402/4; 402/14; 40/359

[58] Field of Search ..... 402/4, 8, 13–15, 402/45; 40/359

[56] References Cited

U.S. PATENT DOCUMENTS

| | | | |
|---|---|---|---|
| 3,092,400 | 6/1963 | Smith | 402/14 |
| 3,298,374 | 1/1967 | Grundell | 402/4 |
| 3,612,708 | 10/1971 | Grundell | 402/8 |
| 3,791,747 | 2/1974 | Grundell | 402/8 |

FOREIGN PATENT DOCUMENTS

| | | | |
|---|---|---|---|
| 230846 | 3/1963 | Austria | 402/8 |
| 2005523 | 9/1970 | Fed. Rep. of Germany | 40/359 |
| 2005106 | 8/1971 | Fed. Rep. of Germany | 402/8 |
| 318252 | 12/1969 | Sweden | 402/4 |
| 1268161 | 3/1972 | United Kingdom | 40/359 |

*Primary Examiner*—Paul A. Bell

*Attorney, Agent, or Firm*—William A. Drucker

[57] ABSTRACT

A filing folder for perforated papers having at least one cover and flexible binding tongues secured to said cover and having a securing part upon which objects such as covers, pockets and the like are hookable with one edge portion of said objects are flush with the free end of said securing part so that said cover tongue and objects are locked relative to each other by a channel bar slid over the spine of the folder.

3 Claims, 6 Drawing Figures

FILING FOLDER FOR PERFORATED PAPERS

The present application is a continuation of application Ser. No. 764,932 filed Feb. 2, 1977, now abandoned which was a continuation of application Ser. No. 522,065 filed Nov. 8, 1974, now abandoned which was itself a continuation-in-part of my application Ser. No. 398765 filed Sept. 19, 1973, now abandoned.

Several types of constructions have been suggested in order to produce a filing folder which can be used in an extremely simple and convenient way, and which can be manufactured at a minimum of costs and furthermore saves space when being used.

In a great number of filing folders of an uncomplicated and cheap type the folders comprise one or more cover members of thin cardboard or similar material and one or more flexible binding tongues for holding perforated papers. In some of these folders, the binding tongues are detachably placed at some distance from the spine of the folder and perpendicularly to said spine.

The present invention relates to the above mentioned type of filing folders for perforated papers and is characterized in that the tongues are secured to at least one of the covers in such a manner that they each have a securing member or part which from said cover projects obliquely towards the spine and extends approximately to said spine, and that objects such as covers, pockets and the like are hookable upon said securing parts and for this purpose are provided with one or several openings having a configuration adapted to the cross section of said securing part and that said objects when hooked upon said securing parts have one edge portion thereof approximately flush with the free end of said securing part such that said cover, the tongues and the objects hooked upon the same may be locked relative to each other by means of a channeled bar which is sideways slid over the spine of the filing folder. Among the technical advantages gained by the present invention are to be noticed not only the simplicity whereby a person can use the filing folder but also the strength and stability of the folder; furthermore the folder can stand steady in an upright position. Of great importance for the filing folder according to the invention is that it is possible to vary the product within wide limits, as the objects to be hooked on the securing members may be varied as desired. In this manner it is possible while maintaining the rest of the file as a standard product to obtain photo albums, files with a plurality of pockets and so forth merely by hooking on the specific parts for example a number of flaps 6 for obtaining such products. To obtain a cheap and rapid connection between a channel bar and covers it is known to provide the end portions of such covers with T-shaped parts obtained by folding the material. This method may however only be used when the material is relatively thin. On the other hand the front cover of a photo album or the like should be relatively stiff. By providing the rear cover with the T-shaped part it is however according to the invention possible to use a stiff front cover. The rear side may be double preferably with a reinforcing board or the like. The front cover member is further constructed in such a way that the cover members in both lying and standing position are parallel with each other and automatically keep a distance from each other of the same size as the thickness of the bundle of papers in the folder. The result thereof is that filing folders according to the invention are much more spacesaving than the filing folders known before used to be stored in an upright position. Among further advantages of the filing folder according to the present invention that ought to be mentioned is, that the folder is very suitable for automatic manufacturing thanks to the construction of the folder.

The invention will now be described more in detail by way of example with reference to the accompanying drawings, wherein.

Figure 1:
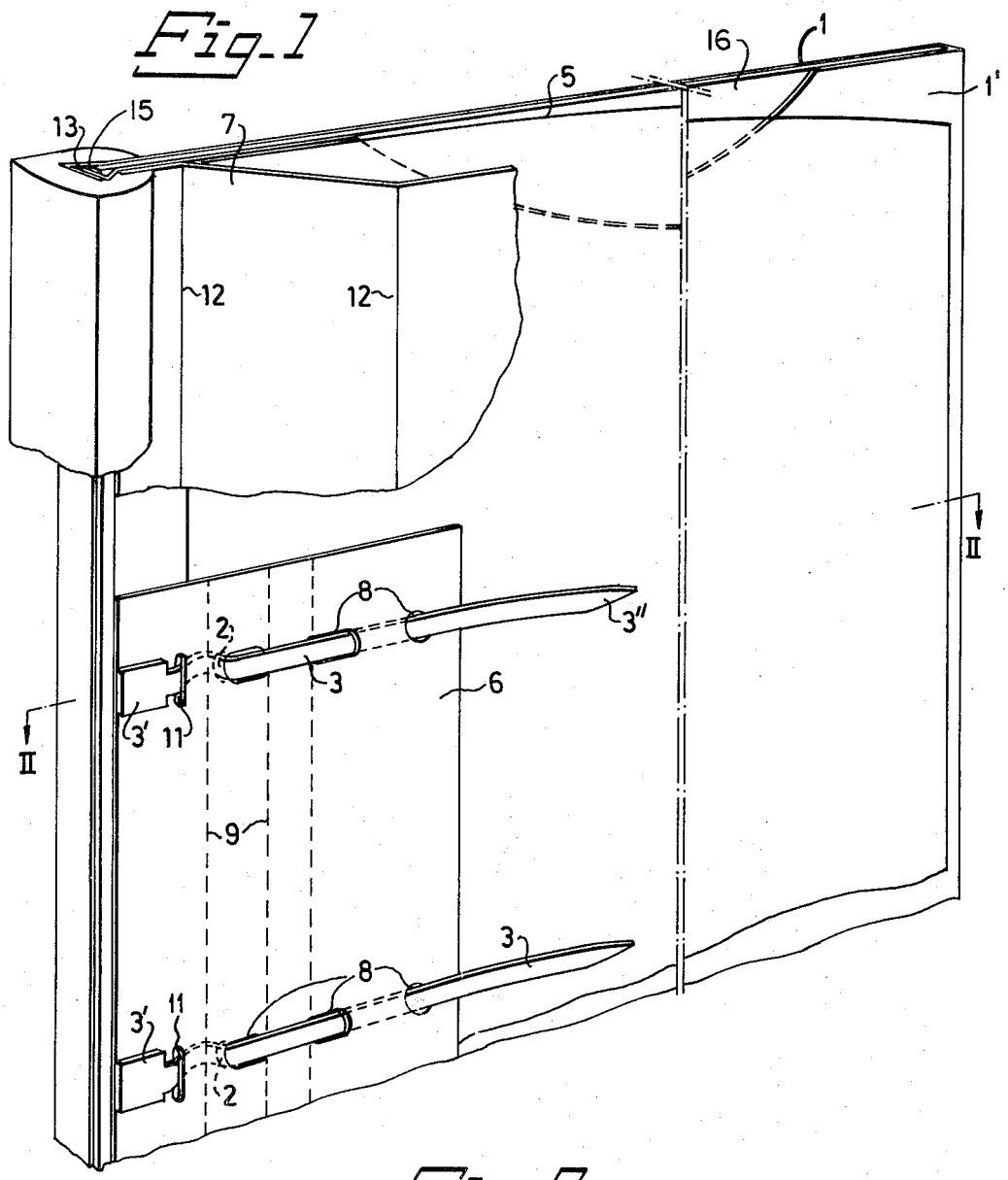
FIG. 1 is a perspective partly broken away front view of a filing folder according to the invention

Referring to the drawings a rear cover member comprises a folded sheet having parts 1 and 1' and a reinforcing member 16 having two rows of holes 2 at one of its longitudinal edges, said holes 2 adapted to hold a number of binding tongues 3 of flexible material. These binding tongues 3 each have at one end thereof an enlarged part 3' which cannot pass through holes 2 and thus serves as a stop member when the tongues are threaded through the holes 2 for holding perforated papers 5. The binding tongues 3 are arranged perpendicularly to the length direction of the rear cover member part 1 as previously known. Furthermore the tongue ends having the enlarged ends $3^1$ are adapted to retain a flap 6 for the perforated papers 5 as well as a front cover member 7. The flap 6 is preferably formed as a strip. The flap 6 has one or more rows of holes 8 for guiding the binding tongues 3 when they have been threaded through the perforated papers 5. The flap 6 has also holes 11 adapted to receive the ends 3' of the binding tongues 3. In order to make it possible for the flap 6 to easily adapt itself to the actual number of papers 5, said flap is provided with a number of folding lines 9, being mutually parallel and located at some distance from each other. The front cover member 7 is provided with holes 11' adapted to allow the passage of the ends 3' of the binding tongues 3, and the front cover member also is provided with two parallel folding lines 12 at a distance from each other of some centimeters, one of said folding lines being placed near to the holes 11 or passing therethrough. By means of said folding lines in the front cover 7, the filing folder according to the present invention has an extreme stability a standing position and additionally the cover members of the folder automatically take a mutually parallel position and keep a distance from each other corresponding to the thickness of the bundle of papers in the folder. In order to facilitate the locking of the different parts of the folder relative to each other at the spine side, one or both cover member parts 1 or 1' is provided at the edges which face the spine of the folder with T-formed parts 13 obtained by folding the material, adapted to be inserted in a channel bar 14, having a groove 15 of a corresponding T-shape. Since the ends of the binding tongues 3 are housed in the channel bar, when the folder is assembled, an extremely firm locking of the different parts of the filing folder is achieved.

Figure 3:
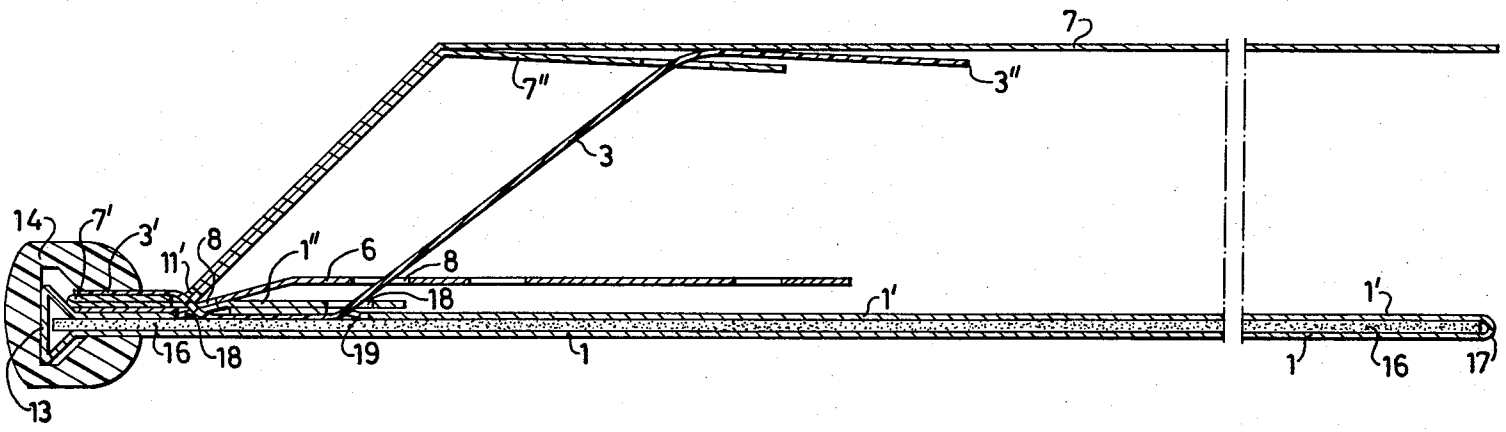
FIG. 3 is a cross-sectional view of a modification of the filing folder shown in FIGS. 1 and 2

The embodiment illustrated in FIG. 3 is a modification of the filing folder according to the present invention and refers to a folder having the front cover 7 thereof provided with a fold 7′ located inside the channel bar 14 to provide a strip 7″ projecting out of said channel and following the contour of front cover part 7. This strip 7″ as well as part 7 has holes intended to just allow passage of the ends 3″ of the binding tongues 3 thereby holding the tongues in place parallel to the front cover. The strip may also be nailed or glued to the inner side of the front cover and thus serves to stiffen up said front cover. Two cuts (not shown) perpendicular to the spine of the folder and reaching the spine could be made in the strip 7″, leaving the top and bottom section of said strip to stiffen the front cover member 7 and the middle section of said strip to replace the flap 6.

Furthermore it is also possible to make the cover members as one single cover member provided in the middle with a T-folded part adapted to be inserted in the channel bar 14 in order to keep the different parts of the filing folder together. The cover member 7 of the folder may be omitted and the supplementary flap 6 can then have the form of a front cover member.

Figure 2:
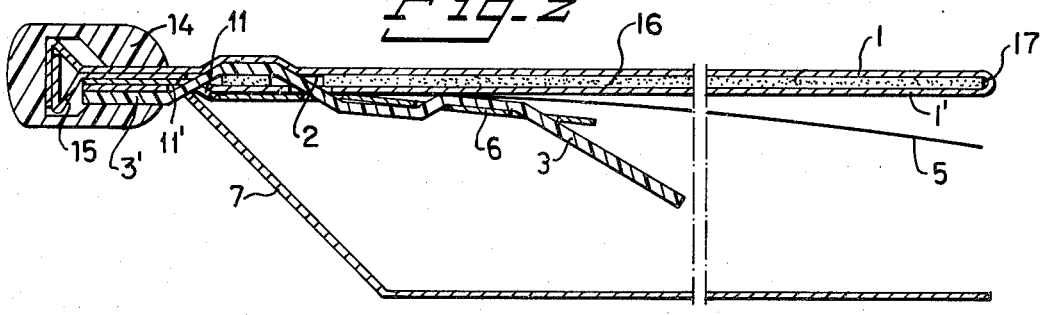
FIG. 2 is a cross-sectional view of said folder along line II—II in FIG. 1

From FIGS. 2 and 3 it is apparent that the rear cover consists of a single sheet which is folded at 17 to constitute two superimposed parts 1, 1′. According to FIG. 3 part 1 continues in the T-shaped part 13 and a part 1″ extends parallel to the parts 1, 1′ but in a direction opposite thereto. Said part 1″ is provided with holes 18 corresponding to the holes 8 of the flap 6. The free end of part 1′ preferably is located between the two rows of holes 8 respectively 11′ and also part 1′ has holes 19 for guiding the binding tongues. By threading the binding tongues through these holes 18, 19 the two cover parts 1′, 1′ are attached to each other and in order to obtain a pocket (not shown) for the reinforcing member 16 in the upper and lower parts of the rear cover may be closed by means of seam, a folded over part of part 1′ or the like.

Part 7″ may replace flap 6 and is then just as said flap preferably provided with mutually parallel folding lines or perforations thereby enabling the part to easily adapt itself to the varying shape of the document bundle.

Figure 4:
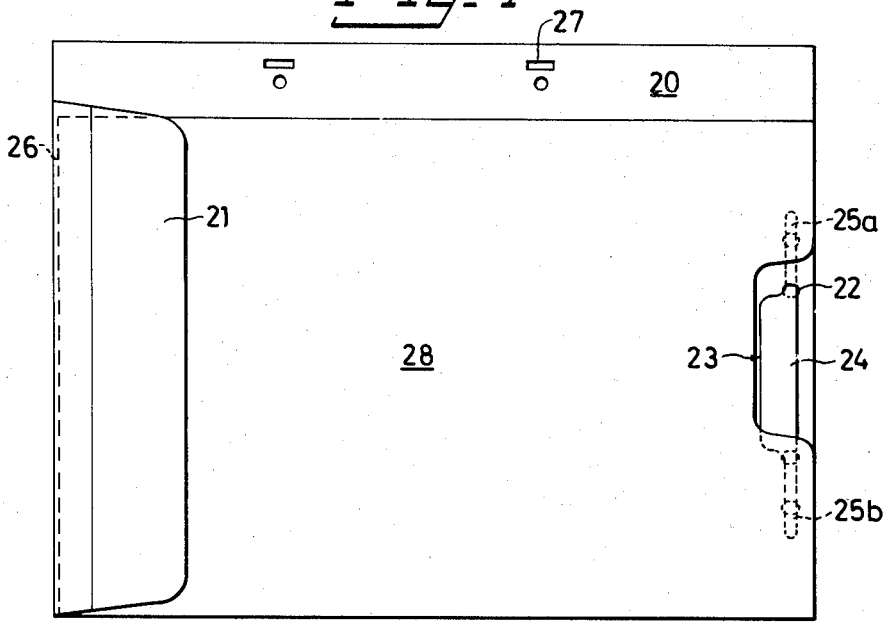
FIG. 4 is a front view of an unit which may be used together with the filing folder according to the FIGS. 1 to 3

When the left end of part 1′ according to FIG. 3 is located at a distance from the channel bar 14 the essential advantage is obtained in that partition strips, pockets or the like may be easily connected to the file or cover by forming said strips with a folded over portion the width of which is less than the distance between the left end of part 1′ and the channel bar. Said folded over part of the strip thus functions as a hook and in fact it is only necessary to slide such a strip in towards the spine of the file as the folded over part will then snap under part 1′ such that the strip will not be removed when it is displaced in a direction away from the spine. The partition strip preferably extends only between the binding tongues 3 and it also can be provided with a separate binding tongue which is directed substantially perpendicular to the binding tongues 3, whereby said separate binding tongue is connected to the partition strip by at least two holes, which are situated on a axis parallel to the channel bar 14. The partition strip can be threaded through an elongated slot in the fold between the parts 7′ and 7″ in within the channel bar 14. Among the units that may be hooked upon the enlarged ends 3′ of the binding tongues may be mentioned the unit illustrated in FIG. 4 which comprises a sheet 20 which at one short side thereof has a folded part 21 and at its opposite side has punched holes 22 for a flap 23 which consists of a relatively wide part 24 which continues in narrow binding tongues 25*a*, 25*b* extending as an extension of one of the long sides of part 24. By inserting these tongues in the holes 22 according to FIG. 4 a flap is obtained under which documents 26 or the like may be introduced. Together with the folded part 21 said flap 23 serves to loosably hold the documents. The flap may also be reversed such that its wider part 24 projects out from the short side of sheet 20 in which case the flap serves as a label holder or a signal. The sheet 20 has near to one of its long sides elongated openings 27 by means of which the sheet may be hooked over the parts 3′ of the binding tongues. The opposite long side of the sheet may of course be provided with a folded part 28 corresponding to part 21 when a still safer holding of the documents is desired. The punched holes 22 for the flap 23 also can be located in the reinforcing member 16, whereby said flap is so situated relative to the cut out portion 28′ that the wide part 24 thereof may pass through said portion 28′.

Figure 5:
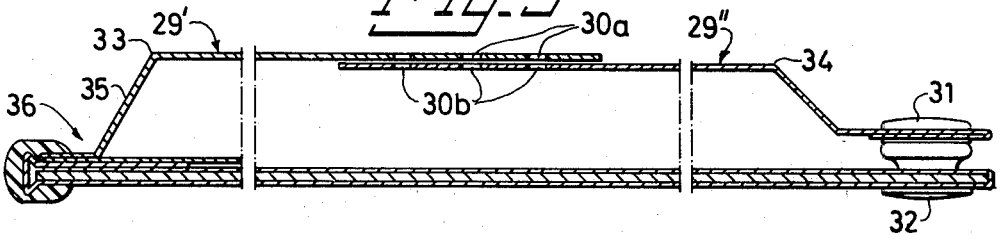
FIG. 5 is a cross-sectional view of another unit which may be used together with the filing folder according to the FIGS. 1 to 3

Another hookable element is illustrated in FIG. 5. By means of this element the file may be easily closed and the thickness of the file may be adapted to the actual amount of documents stored therein. The element shown comprises two parts 29′, 29″ from which part 29′ has elongated openings 27 for the hooking. By bringing one series of the holes 30*a* in register with one series of the holes 30*b* for instance by introducing pens therethrough the two parts 29′, 29″ are mutually guided and may be mutually connected by means of adhesive tapes, staples or the like. Parts 29′, 29″ are provided with folding lines 33 and 34 similar to these of the front file sides of the other figures in the drawing. The oblique walls 35 thereby obtained have in all the embodiments the effect that a space 36 is generated which facilitates the grasping of the file. The obliquely extending wall 35 may further be provided with a label which consequently will be readable also when the file or cover stands in a book shelf among other covers, books or the like. Further a transition is obtained the inclination of which corresponds to the amount of stored documents. Instead of the snap fastener connection according to FIG. 5 it is also possible to provide the sheet part with through holes through which are threaded one or more resilient bands, for instance rubber bands and in this case the holes are located so as to enable the bands to be laid around the corners of the front cover in a manner known per se.

Figure 6:
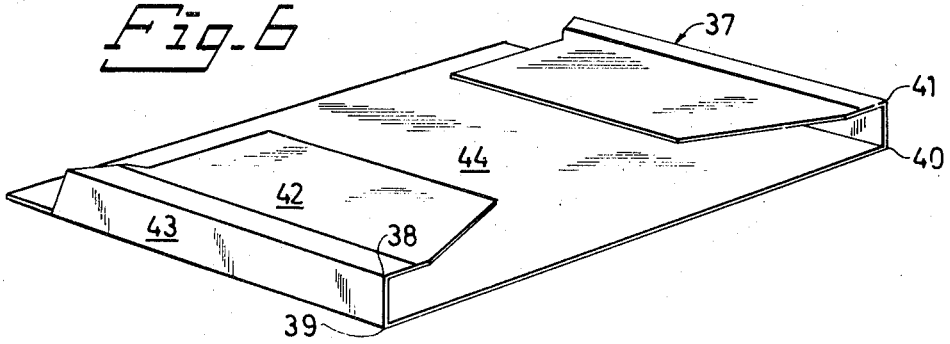
FIG. 6 is a perspective view of still another unit which may be used together with the filing folder according to the FIGS. 1 to 3.

Owing to the fact that the rear cover side is double documents may be easily stored by using a unit 37 according to FIG. 6. This unit consists of a rectangular blank which by means of folding lines 38–41 may be formed according to FIG. 6. By arranging the unit such that the parts 42 and 43 extend in the extension of part 44 the unit may be introduced between the two layers 1, 1′ of the rear cover whereupon the unit may be folded to the shape according to FIG. 6. A stiff sheet or plate may also be introduced between the two layers and this sheet may project outside the file or cover. Thus it is possible to connect other files or the like to the channel bar.

I claim:

1. A filing folder for perforated papers, comprising: at least one stiff rectangular cover, at least one elongated binding tongue of a flexible material arranged approximately perpendicular to and extending away from one edge of said cover, a portion of said binding tongue adjacent one end thereof being secured to said cover adjacent said edge of the cover, said one end of the binding tongue forming a laterally enlarged part, a flap having an opening therein for receiving said enlarged part of the tongue so as to be hooked thereon between said one edge of the cover and the attached portion of the tongue with the edge of the flap flush with the free end of the laterally enlarged part of the tongue, said flap having further openings therein for receiving the non-enlarged part of the binding tongue after it has been threaded through perforated papers, and a channelled bar locking together said cover marginal edge, said enlarged part of the tongue and the marginal edge of the flap.

2. A filing folder as claimed in claim 1 including a front cover provided with mutually parallel folding lines, one of which lines is located near to said stiff cover edge and the other of said lines is located at a relatively short distance therefrom, said channel bar locking one marginal edge portion of said front cover between said tongue enlarged part and said stiff cover marginal edge.

3. A filing folder as claimed in claim 2 wherein said line located near to said cover edge passes over said opening in the flap.

* * * * *